United States Patent [19]

Lee

[11] Patent Number: 4,998,733

[45] Date of Patent: Mar. 12, 1991

[54] GOLF BALL

[75] Inventor: Kyou Sang Lee, Seoul, Rep. of Korea

[73] Assignee: Heubg-Ah Tire & Rubber Co., Ltd., Kinhae, Rep. of Korea

[21] Appl. No.: 506,700

[22] Filed: Apr. 4, 1990

[30] Foreign Application Priority Data

Aug. 10, 1989 [KR] Rep. of Korea ..... 11359

[51] Int. Cl.[5] ..... A63B 37/14

[52] U.S. Cl. ..... 273/232; 40/327

[58] Field of Search ..... 273/232; 40/327

[56] References Cited

U.S. PATENT DOCUMENTS 4,142,727 3/1979 Shaw et al. ..... 273/232
4,560,168 12/1985 Aoyama ..... 273/232
4,946,167 8/1990 Yamada ..... 273/232
4,948,143 8/1990 Aoyama ..... 273/232

FOREIGN PATENT DOCUMENTS 80-1003 9/1980 Rep. of Korea ..... 273/232

*Primary Examiner*—George J. Marlo
*Attorney, Agent, or Firm*—Darby & Darby

[57] ABSTRACT

A golf ball having a spherical surface with a plurality of dimples being arranged with fifteen axes of symmetry. The spherical surface of the ball is divided into ten regular hexagons corresponding to the faces of a regular decahedron. Each regular hexagon is further divided into six regular triangles. Each regular triangle is subdivided into two right-angled triangles, so that all right-angled triangles from a PHC (Propellant Hexagon Configuration).

1 Claims, 8 Drawing Sheets

GOLF BALL

BACKGROUND OF THE INVENTION

The present invention relates to golf balls, and particularly to a golf ball which has dimples which are evenly and uniformly distributed so that the ball has fifteen axes of symmetry. Each axis of symmetry is not an actual parting line drawn on the surface of the golf ball, but a false parting line for uniformly arranging dimples over the surface of the golf ball.

Such false parting lines are utilized for distributing dimples of various sizes uniformly and symmetrically over the surface of the golf ball without leaving dimple-free areas, thus eliminating either heavy concentrations of dimples or rarefied areas in which the dimple spacing is large, minimizing multiple parallel straight rows of dimples formed by the said false parting lines, and distributing dimples of various sizes uniformly and symmetrically over the surface of the golf ball. Accordingly, an ideal golf ball should have a plurality of axes of symmetry, but no parallel straight rows of dimples and in case multiple dimple sizes are used, the various sized dimples should be distributed and mixed uniformly and symmetrically over the surface of the ball.

In order to improve consistency and accuracy of golf ball dimples, various attempts have been made to distribute dimples over the surface of golf ball with many axes of symmetry and without dimple-free areas and to eliminate parallel straight rows of dimples.

For example, Korean Patent Publication No. 80-1003 describes a golf ball in which spherical surface of the ball is divided into twelve regular pentagons A, as shown in FIG. 1, each pentagon A subdivided by ten parallel parting lines into outer quadrangulars 1, inner triangles 2 and an inner regular pentagon 3. 360 dimples are distributed over the surface of the ball by providing four dimples for each outer quadrangular 1, one dimple for each inner triangle 2 and five dimples for one inner regular pentagon 3. However, the golf ball has only ten axes of symmetry.

If the above case and the present invention are applied to same sized golf balls and if one of twelve pentagons A corresponding to the faces of a regular dodecahedron is assumed as a unit, this unit should have the theoretical area which is 1.2 times as large as that of the unit of the present invention. Accordingly, the number of the axes of symmetry, twelve, is calculated by 1.2 times 10(axes of symmetry).

FIG. 2 shows a case in which the surface of golf ball is divided into twenty regular triangles B, each of which is subdivided into six right-angled triangles 4. 360 dimples are distributed over the surface of the ball by providing three dimples for each right-angled triangles 4. In this invention, too, the golf ball has no more than ten axes of symmetry.

If the above case and the present invention are applied to same sized golf balls and if one of twenty regular triangles B corresponding to the faces of a regular icosahedron is assumed as a unit, this unit should have the theoretical area which is twice as large as that of the unit of the present invention. Accordingly, the number of the axes of symmetry is calculated at ten.

U.S. Pat. No. 4,560,168 describes a golf ball in which the surface of the ball is divided into twenty regular triangles C, as shown in FIG. 3. Each triangle is further divided into four regular triangles, that is, three apical triangles 5 and one central triangle 6. Dimples are arranged in each apical triangle 5 and each central triangle 6, so that no dimples intersect the sides of the central triangle 6. However, the golf ball of this case has only nine axes of symmetry.

If the above case and the present invention are applied to same sized golf balls and if one of twenty regular triangles C corresponding to the faces of a regular icosahedron is assumed as a unit, this unit should have the theoretical area which is twice as large as that of the unit of the present invention. Accordingly, the number of the axes of symmetry is calculated at nine.

However, the above-mentioned conventional dimple patterns have a disadvantage of having multiple parallel straight rows of dimples which are formed when dimples are arranged on multiple pararrel straight lines formed by each triangle unit B or C, as indicated by two-dotted lines in FIGS. 2 and 3.

SUMMARY OF THE INVENTION

Therefore, an object of the present invention is to provide a golf ball which has a dimple arrangement of PHC (Propellant Hexagon Configuration), in which each vane is shaped into a right-angled triangle, in order to minimize formation of parallel straight rows of dimples.

Other object of the present invention is to provide a golf ball having multiple axes of symmetry, in order to eliminate uniform distribution of dimples on parallel straight lines which may be formed and also to provide symmetrical rows of dimples so that the dimples can be distributed uniformly over the spherical surface of the ball with minimized dimple-free areas.

In accordance with the present invention, these objects can be accomplished by providing a golf ball having a spherical surface with a plurality of dimples formed therein, such dimples being arranged with fifteen axes of symmetry by dividing the spherical surface into ten spherical regular hexagons corresponding to the faces of a regular decahedron, further dividing each of the said spherical regular hexagons into six regular triangles, and subdividing each of the said triangles into two right-angled triangles, so that all right-angled triangles form a PHC (Propellant Hexagon Configuration).

BRIEF DESCRIPTION OF THE DRAWINGS

The present invention will be explained in conjunction with illustrative embodiments shown in the accompanying drawings, in which

FIG. 5 is unfolded;

DETAILED DESCRIPTION OF THE PREFERRED EMBODIMENTS

Figure 1:
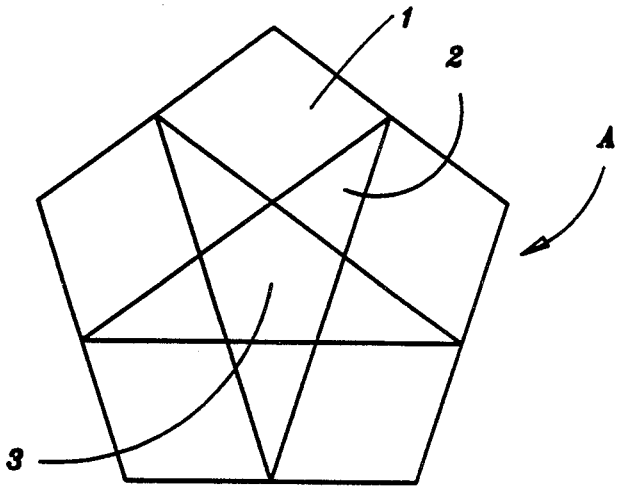
FIGS. 1 to 3 are illustrative unfolded plan views each showing false parting lines of symmetry dividing the spherical surface of a golf ball in order to arrange dimples therein, in accordance with the prior art.
Figure 2:
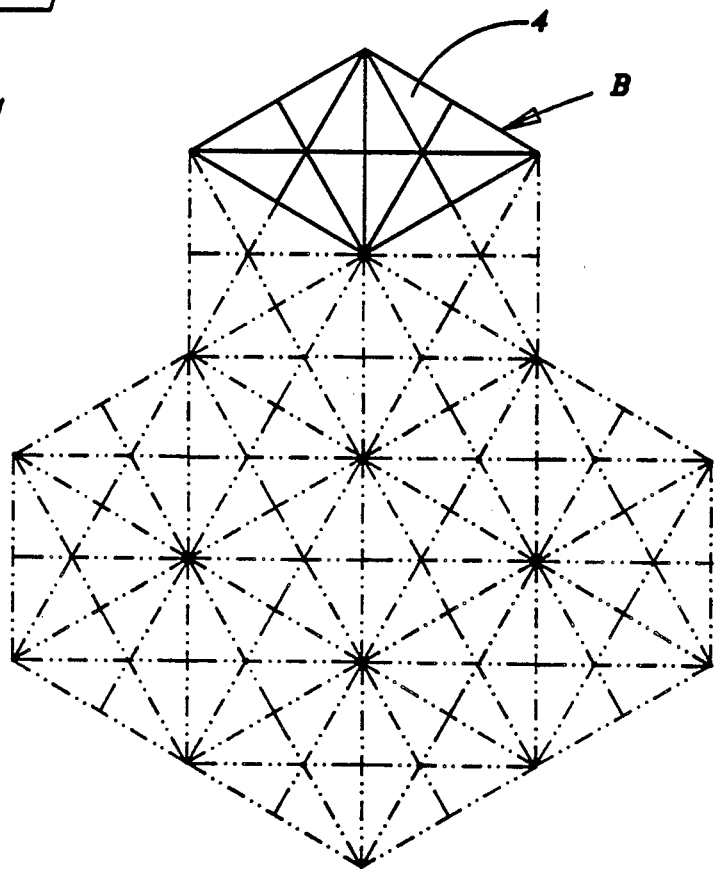
Figure 3:
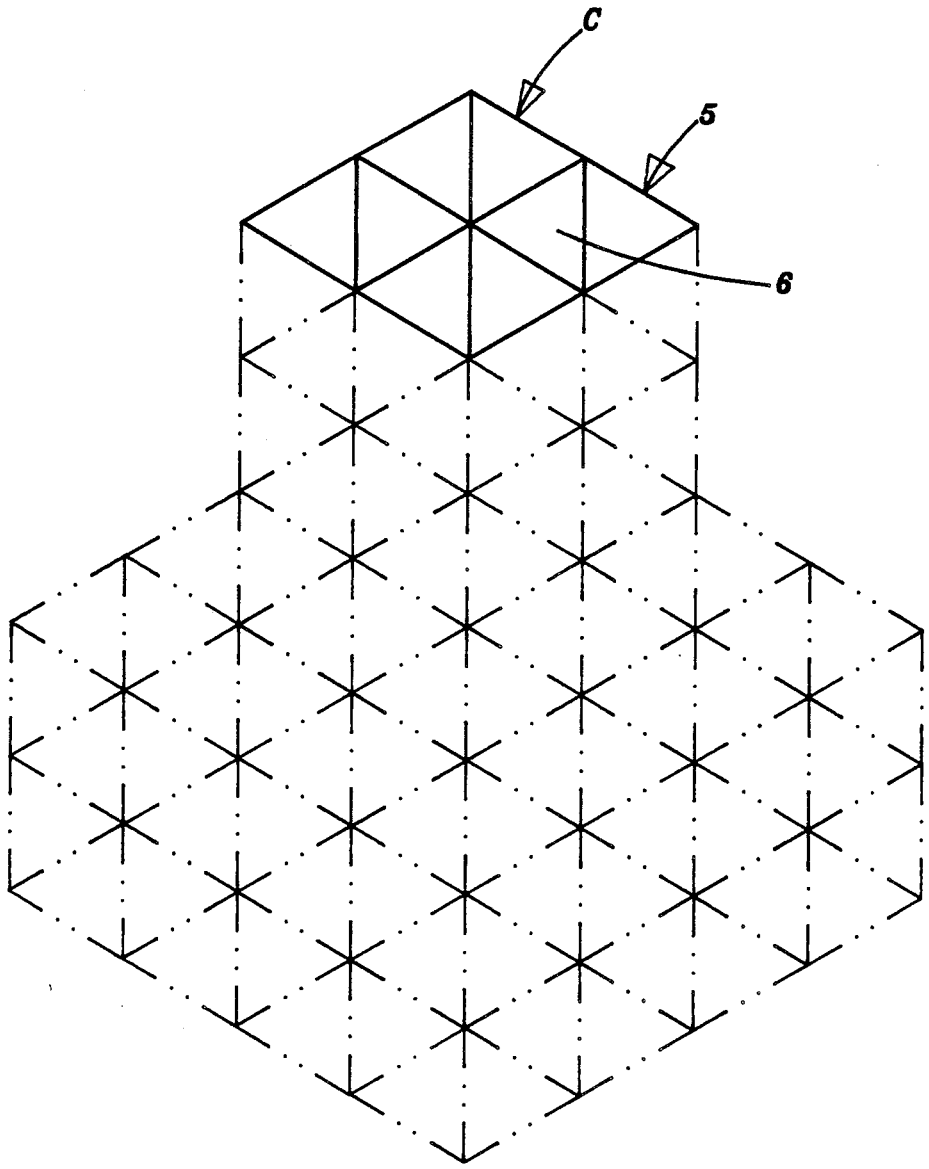
Figure 4:
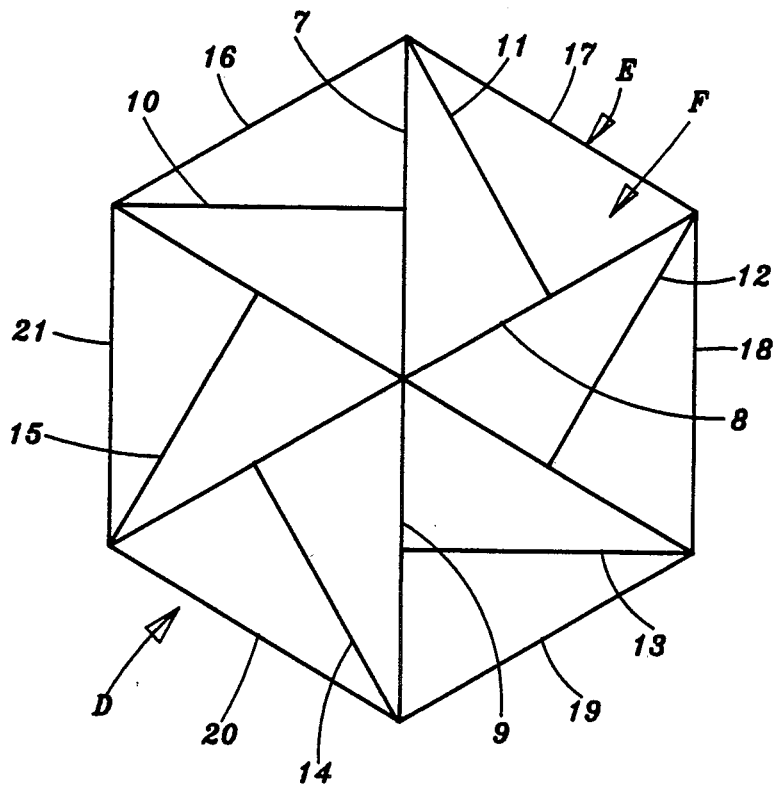
FIG. 4 is an illustrative unfolded plan view showing one of ten spherical regular hexagons on the spherical surface of the golf ball which is divided into six regular triangles which are subdivided into twelve right-angled triangles.

FIG. 4 illustrates a regular hexagon D which is one of the ten identical spherical regular hexagons on the spherical surface of a golf ball which correspond to the faces of a regular decahedron. The outer axes of symmetry 16 to 21 are part of the axes of symmetry which form ten regular hexagons of the regular decahedron. The regular hexagon D is divided into six regular triangles E by the central axes of symmetry 7 to 9. The regular triangles E are subdivided into twelve right-angled triangles F by the axes of symmetry 10 to 15, so that all right-angled triangles F form a PHC (Propellant Hexagon Configuration), in accordance with the present invention. Desired number of dimples are filled in all right-angled triangles F to form a golf ball.

The outer axes of symmetry 16 to 21 of the regular hexagon D are false parting lines for dividing, as a unit, one of ten spherical identical regular hexagons on the spherical surface of the golf ball which corresponds to the faces of a regular decahedron. The central axes of symmetry 7 to 9 are false parting lines for dividing the unit D into six regular triangles E. However, these axes of symmetry do not function as false parting lines for dividing each of the other nine regular hexagons, as a unit.

For example, the central axes of symmetry 8 and 9 of the regular hexagon D will function as the outer axes of symmetry 40 and 41, respectively, in the case of the other regular hexagon G. The other axes of symmetry 16 and 20 of the regular hexagon D will function as the center axes of symmetry 30 and 31, respectively, in the case of the other regular hexagon G.

The axes of symmetry 10 to 15 are false parting lines for dividing the regular hexagon D of a unit to have the PHC (Propellant Hexagon Configuration).

Figure 5:
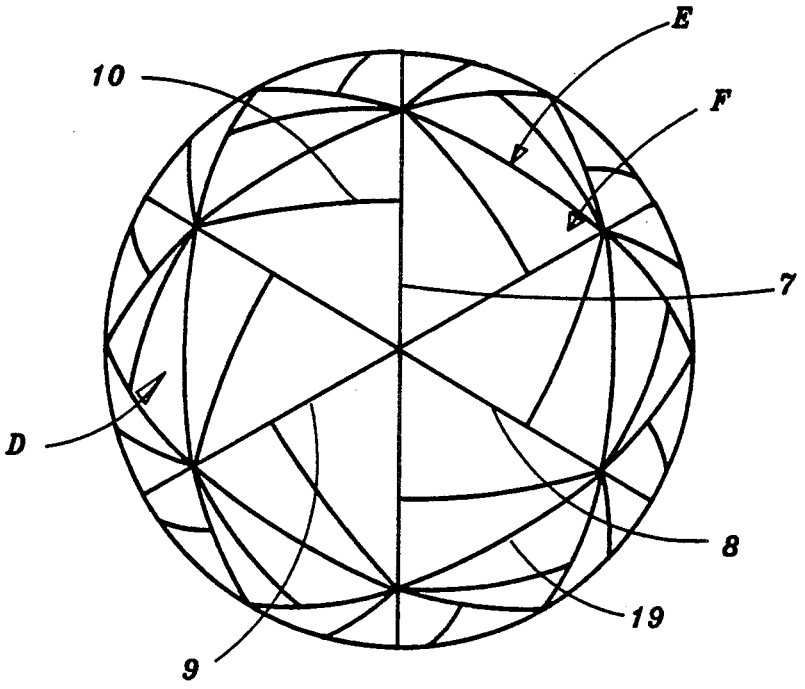
FIG. 5 is an illustrative view showing the formation of axes of symmetry when the spherical regular hexagons shown in FIG. 4 are applied to the spherical surface of the golf ball.

Although the false parting lines are described with respect to the regular hexagon D to simplify the description, they are also applied to all of the other regular hexagons on the spherical surface of the golf ball, as shown in FIG. 5.

Figure 6:
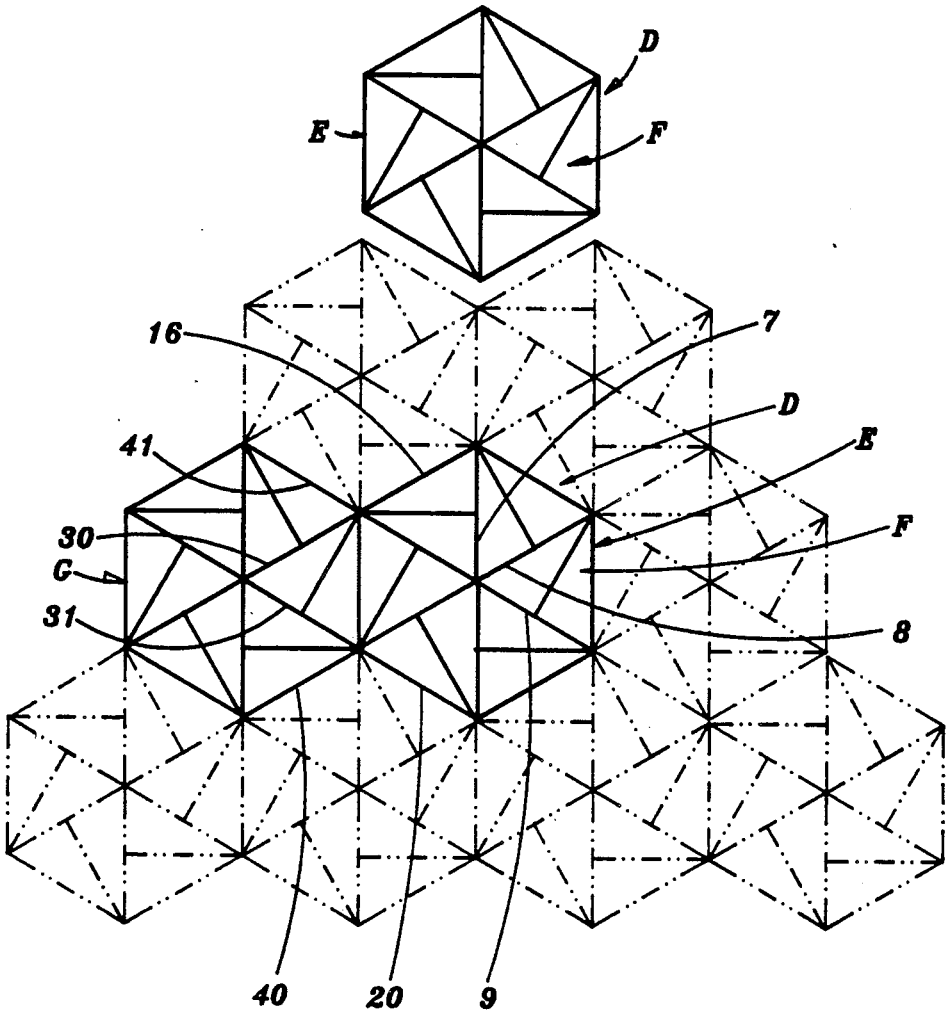
FIG. 6 is an illustrative view showing axes of symmetry when

As shown in FIG. 6 which is a unfolded view of FIG. 5, the right-angled triangles F divided from each regular hexagon are not arranged in one direction, but arranged in various directions to form a PHC (Propellant Hexagon Configuration). Accordingly, when dimples are filled in the right-angled triangles F arranged above, it is possible to minimize or eliminate formation of parallel straight rows of dimples.

Figure 7:
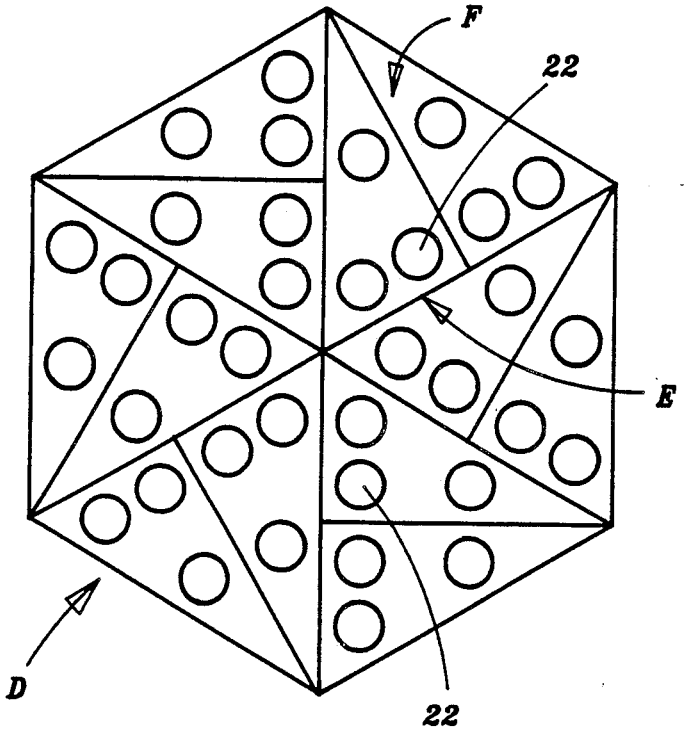
FIG. 7 is an illustrative view showing a basic dimple pattern applied to the spherical regular hexagon shown in FIG. 4, in accordance with the present invention.
Figure 8:
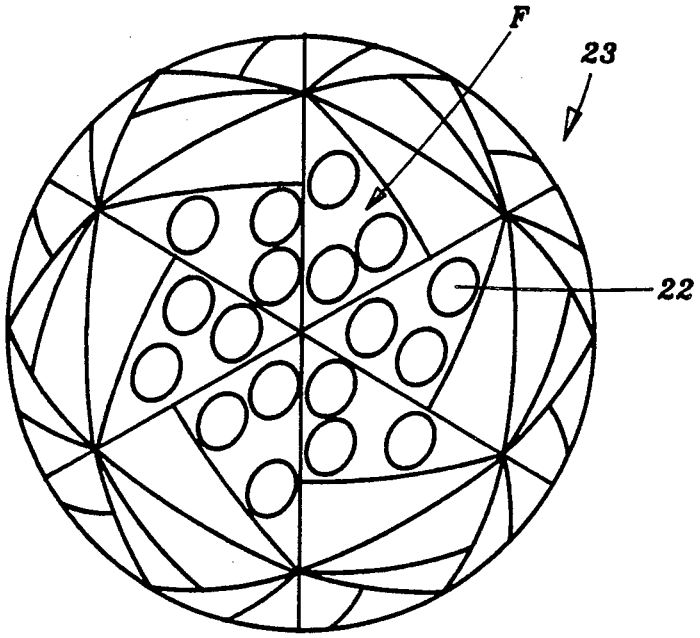
FIG. 8 is a perspective view showing the basic dimple pattern of FIG. 7 when it is applied to the spherical surface of the golf ball.
Figure 9:
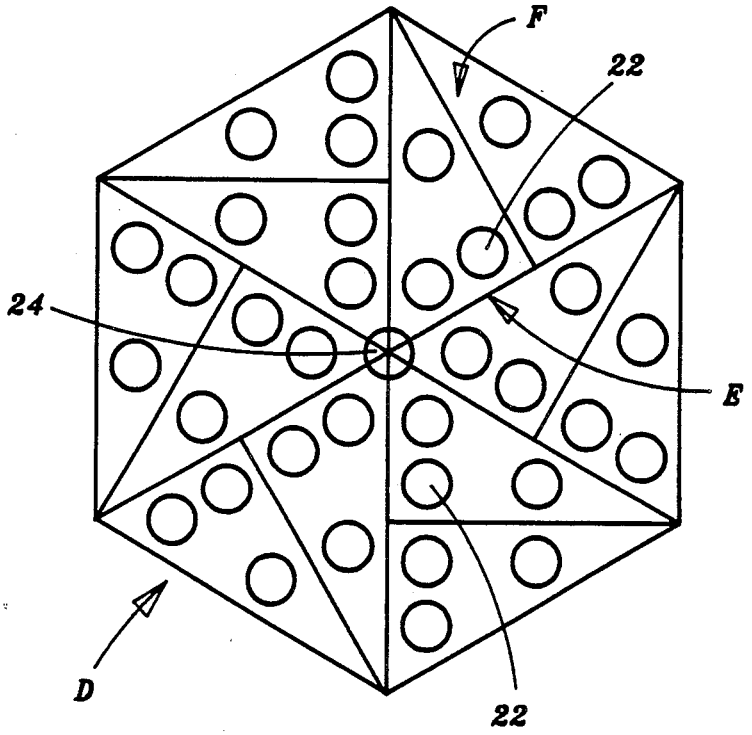
FIG. 9 is an illustrative view showing another dimple pattern applied to the spherical regular hexagon, in accordance with the present invention.
Figure 14:
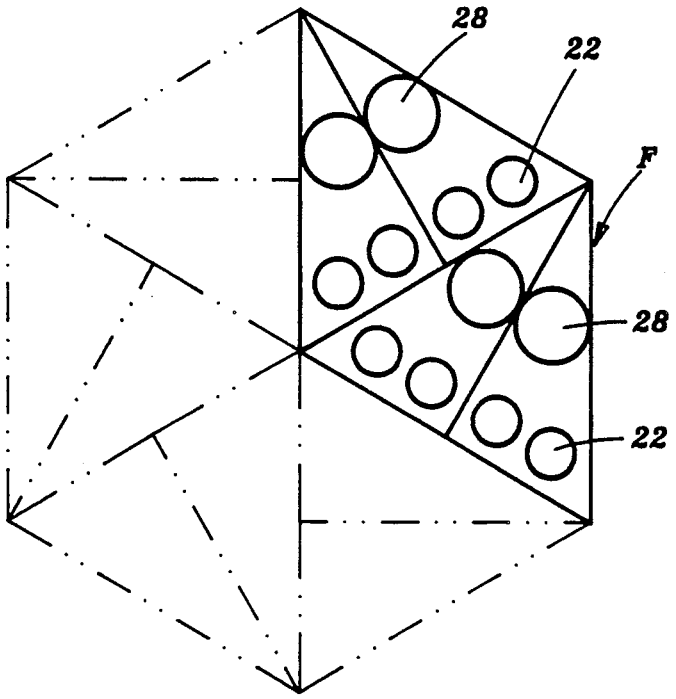

The dimples pattern for arranging dimples in each spherical regular hexagon can be varied, depending upon the desired number and density of dimples, and the appearance of a golf ball. FIGS. 7 and 8 illustrate the basic dimple pattern in which 360 dimples are distributed over the spherical surface of the golf ball. FIGS. 9 and 14 illustrate different dimple patters in accordance with the present invention.

In the dimple pattern shown in FIGS. 7 and 8, each right-angled triangle F encloses 3 dimples 22, each regular triangle E 6 dimples 22, and each regular hexagon D 36 dimples 22, for a total of 360 dimples 22, because the golf ball 23 has ten regular hexagons D.

Figure 10:
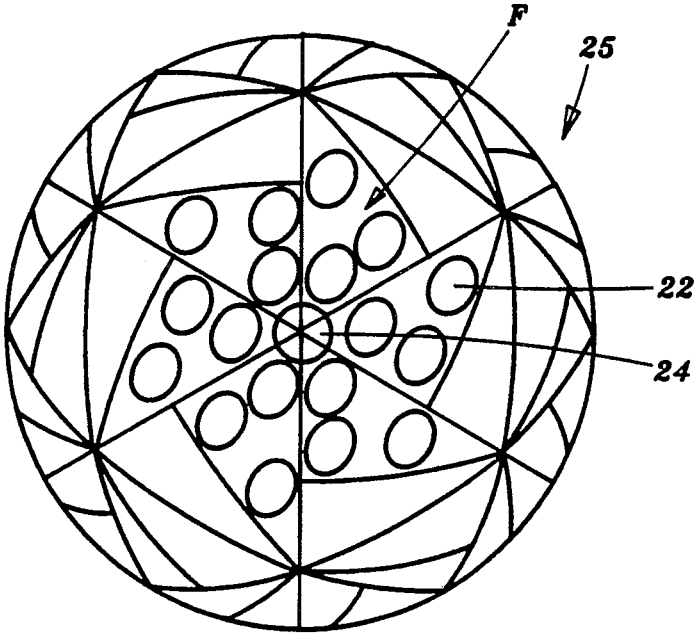
FIG. 10 is a perspective view showing the dimple pattern of FIG. 9 when it is applied to the spherical surface of the golf ball.

FIGS. 9 and 10 illustrate a different dimple pattern in which a dimple 24 is arranged on the central apex of each regular hexagon D. In this dimple pattern, the golf ball 25 has a total of 370 dimples, because, in addition to 360 basic dimples 22, the regular hexagons D encloses ten dimples 24.

Figure 11:
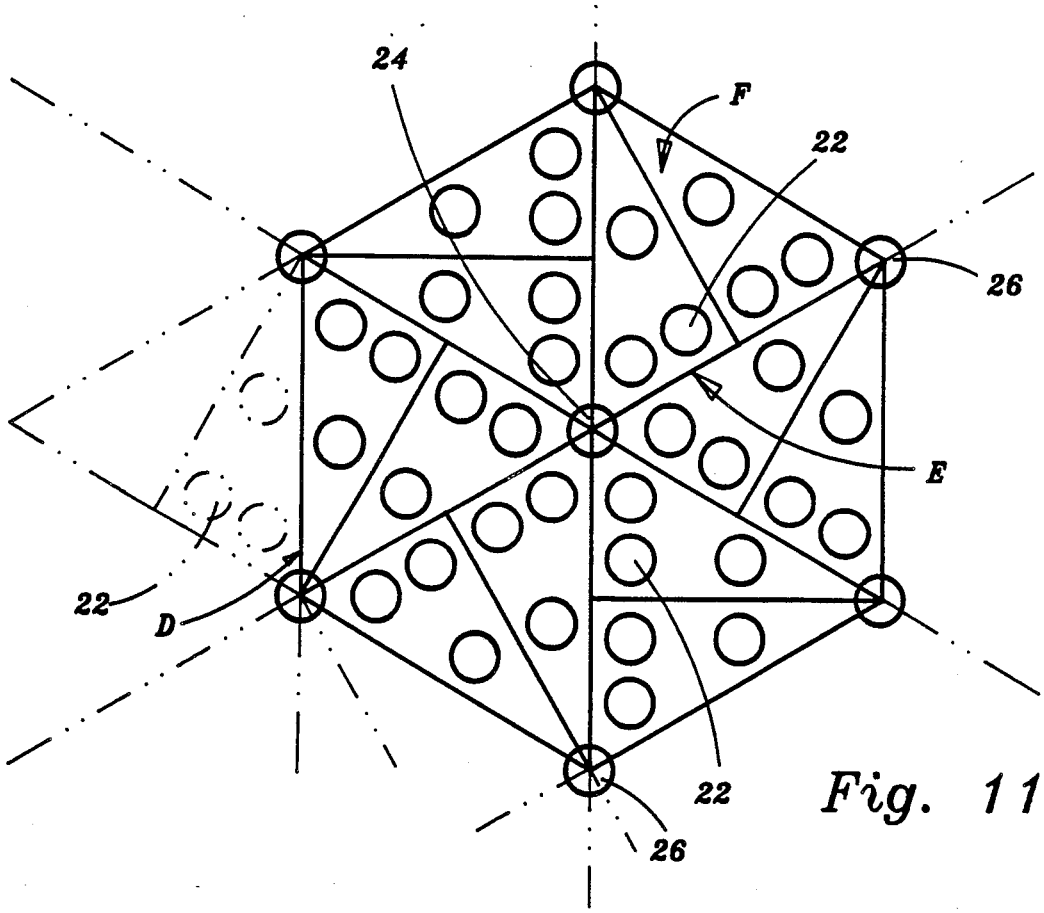
FIG. 11 is an illustrative view showing another dimple pattern applied to the spherical regular hexagon, in accordance with the present invention.
Figure 12:
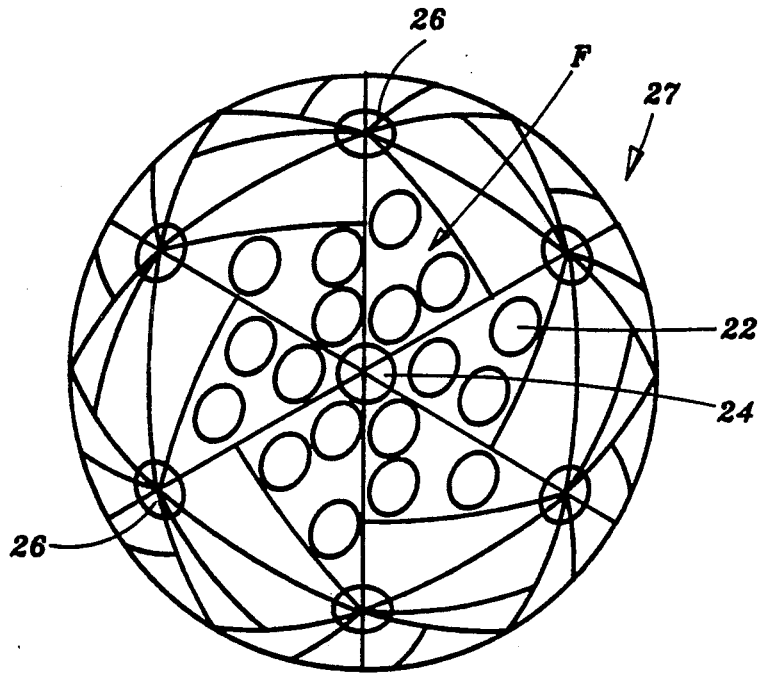
FIG. 12 is a perspective view showing the dimple pattern of FIG. 11 when it is applied to the spherical surface of the golf ball.

FIGS. 11 and 12 illustrate a different dimple pattern in which a partial dimple 26 is arranged on each of six apexes of each regular hexagon D. The partial dimple 26 is one third of one of the dimples 22. This means that each regular hexagon D has 2 dimples. In this dimple pattern, the golf ball 27 has a total of 390 dimples, for ten hexagons D enclose 20 dimples corresponding to 60 partial dimples 26, in addition to ten dimples 24 and 360 basic dimples 22.

Figure 13:
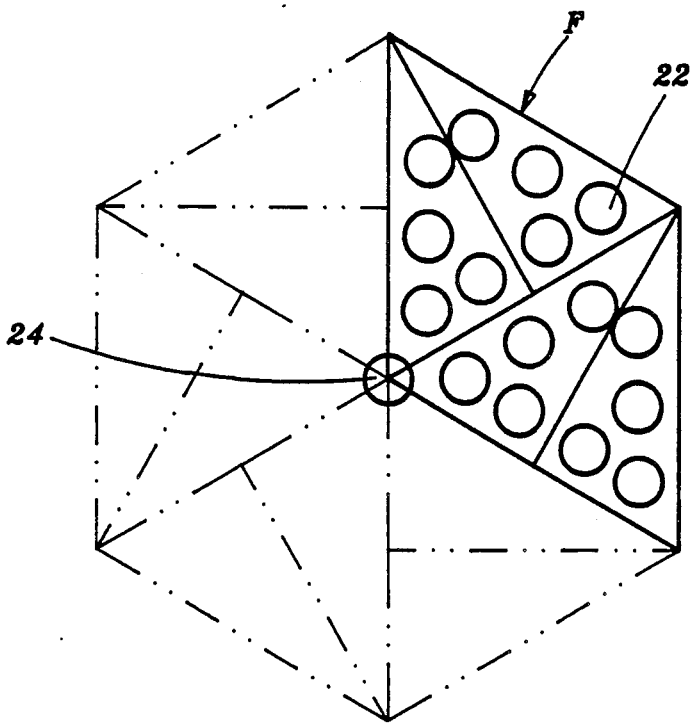
FIGS. 13 and 14 are illustrative views each showing another dimple pattern according to the present invention.

The dimple pattern is not limited to those mentioned above. Different dimple patterns can be made, when dimples contact with or pass the parting lines. Furthermore, when each of the right-angled triangles F encloses four dimples 22 as shown in FIG. 13, a dimple pattern having a total of 480 dimples can be made. In case a dimple 24 is arranged on the central apex of each regular hexagon in the above case, a dimple pattern having a total of 490 dimples can be made. In order to minimize dimple-free areas at the smallest angled apex portion of each right-angled triangle F, the apex portion may enclose a dimple 28 having the size different from that of the dimple 22. The dimples may be any size, configuration or depth, provided that the formed dimple pattern does not depart from the scope of the above-mentioned basic dimple pattern.

As apparent from the above description, the present invention provides a golf ball having fifteen axes of symmetry per one unit hedron, which is many more compared with those of the prior art, and a PHC (Propellant Hexagon Configuration) dimple pattern formed by uniformly dividing the regular hexagon unit by said axes of symmetry. Thus, it is possible to minimize formation of parallel straight rows of dimples and to distribute various sized dimples uniformly and symmetrically over the spherical surface of the golf ball with minimized dimple-free areas. As a result, a golf ball formed in accordance with the present invention can fly longer than conventional balls, while maintaining an optimum trajectory.

What is claimed is :

1. A golf ball having a spherical surface with a plurality of dimples formed therein, such dimples being arranged with fifteen axes of symmetry by dividing the spherical surface into ten spherical regular hexagons corresponding to the faces of a regular decahedron, further dividing each of the said spherical regular hexagons into six regular triangles, and subdividing each of the said triangles into two right-angled triangles, so that all right-angled triangles form a PHC (Propellant Hexagon Configuration).

* * * * *